United States Patent [19]

Bayerkohler et al.

[11] Patent Number: 4,831,932

[45] Date of Patent: May 23, 1989

[54] DETONATOR

[75] Inventors: Mark A. Bayerkohler, Brooklyn Center; William O. Maruska, Minnetonka, both of Minn.

[73] Assignee: Honeywell Inc., Minneapolis, Minn.

[21] Appl. No.: 85,921

[22] Filed: Aug. 17, 1987

[51] Int. Cl.[4] ..... F42C 19/12

[52] U.S. Cl. ..... 102/202.5; 102/202.7; 102/202.14

[58] Field of Search ..... 102/202.5, 202.7, 207, 102/216, 218, 202.14

[56] References Cited

U.S. PATENT DOCUMENTS

| | | | |
|---|---|---|---|
| 3,134,329 | 5/1964 | Zeman | 102/207 |
| 3,272,127 | 9/1966 | Betts et al. | 102/202.14 |
| 3,541,961 | 11/1970 | Larson | 102/202.7 |
| 4,312,271 | 1/1982 | Day et al. | 102/202.14 |
| 4,402,269 | 9/1983 | Smith | 102/202.5 |
| 4,471,697 | 9/1984 | McCormick et al. | 102/202.14 |
| 4,484,960 | 11/1984 | Rucker | 102/202.5 |
| 4,602,565 | 7/1986 | MacDonald et al. | 102/202.7 |
| 4,729,315 | 3/1988 | Proffit et al. | 102/202.5 |
| 4,788,913 | 12/1988 | Stroud et al. | 102/202.5 |

FOREIGN PATENT DOCUMENTS

| | | | |
|---|---|---|---|
| 581316 | 8/1959 | Canada | 102/202.5 |
| 129679 | 1/1985 | European Pat. Off. | 102/207 |

*Primary Examiner*—Deborah L. Kyle
*Assistant Examiner*—Richard W. Wendtland
*Attorney, Agent, or Firm*—R. W. Jenson; E. W. Hughes

[57] ABSTRACT

A detonator 24 for a projectile has a cylindrical housing 32. Housing 32 is provided with an integral base 32. A cylindrical initiator recess 38 is formed in the outer surface 40 of base 26 and an inner stress concentrating recess 42 is formed in the inner surface 44 of base 26. The two recesses 38, 42 define a circular disc 46 of uniform thickness. A bridge wire 56 is formed on a printed circuit board 22. The bridge wire 56 is coated with a temperature sensitive explosive 60. Housing 32 is positioned on board 22 with recess 38 and board 22 defining an initiator chamber 62 in which are located bridge wire 56 and explosive 60. A stab sensitive detonator 64 is positioned in housing 32 with stab sensitive explosive 66 of SSD 64 positioned in close proximity to the inner surface 44 of base 26. A firing signal, a large electrical current, when produced by a fuze 10 heats bridge wire 56 to a temperature at which explosive 60 is ignited. The pressure of the gas produced by burning explosive 60 severs disc 46 from plate 26 and drives it into explosive 66 of SSD 64 with enough force to initiate SSD 64.

13 Claims, 1 Drawing Sheet

DETONATOR

The Government has rights in this invention pursuant to Contract No. F08635-85-C0150, awarded by the Department of the Air Force.

CROSS REFERENCE TO RELATED APPLICATIONS

The following application Ser. No. 85,688, filed Aug. 17, 1987, entitled, "Safing and Arming Mechanism" by William O. Maruska and Mark A. Bayerkohler, the disclosure of which is hereby incorporated by reference into this application, was filed concurrently with this application, and has issued as U.S. Pat. No. 4,770,096, on Sept. 13, 1988. Both applications are assigned to the same assignee.

BACKGROUND OF THE INVENTION (1) Field of the Invention

This invention is in the field of electrically initiated detonators for smaller caliber electronically fuzed projectiles containing a high explosive bursting charge such as are fired from rapid fire guns.

(2) Description of the Prior Art

To increase the effectiveness of smaller caliber, such as 20–30 mm projectiles, fired from rapid fire guns mounted on aircraft, for example, projectiles of such caliber have been developed which include a high explosive bursting charge located within the casing of the projectile. Electronic fuzing systems mounted in the base of a projectile have also been developed with safing and arming (S&A) mechanisms which complete the firing train of the projectile from a detonator to the bursting charge after the projectile is fired from a rapid fire gun, for example.

Electronic fuzing systems, typically located in the base of such a projectile, have a capability of sensing, or detecting, when the projectile strikes a target. When such an event is detected, the fuzing system will produce an electrical firing signal to initiate a detonator which, when the firing train between the detonator and the bursting charge of the projectile is complete and the detonator is initiated, results in the bursting charge of the projectile detonating. Production of the firing signal may be delayed for a predetermined short period of time after the projectile hits-the target, such as an aircraft, to maximize damage to the target aircraft.

Electronic base fuzes for such projectiles require a detonator that can be initiated by an electrical firing signal produced by the fuze. It is necessary that such a detonator be highly reliable in operation, and the cost of the detonator be minimized. In addition, the volume of the detonator as well as the fuze, must be minimized to maximize the amount of high explosive bursting charge the projectile can contain, and thus increase the projectiles effectiveness.

SUMMARY OF THE INVENTION

The present invention provides an electronically initiated detonator for an electronic base fuze of a projectile containing a high explosive bursting charge. The fuzing system produces an electric firing signal under predetermined circumstances, such as after a predetermined delay has elapsed after the projectile strikes a target. The electrical firing signal initiates the detonator, which will, if the firing train through the S&A device is complete, or the projectile is armed, cause the bursting charge of the projectile to detonate.

The detonator includes a detonator housing having a base closing one end of the housing. An initiator recess is formed in the outer surface of the base and a second recess is formed on the inner surface of the base with the portion of the wall of the base between the two recesses defining a circular disc of substantially uniform thickness. A circuit board of the electronic fuze has a detonator bridge wire made of a suitable electrical conductor formed on a portion of one surface of the substrate. The bridge wire is electrically connected to the electronic fuze so that the electrical firing signal when produced by the fuze will flow through the detonator bridge wire. The bridge wire is in direct contact with a temperature sensitive explosive mixture. The detonator housing is positioned, or mounted on the circuit board with the initiator recess overlaying the bridge wire and the temperature sensitive explosive mix in contact with the bridge wire. A conventional stab sensitive detonator (SSD) is positioned within the detonator housing with the stab sensitive end of the SSD in close proximity to the inner surface of the base of the detonator housing. When the fuze produces an electrical firing signal, a large electric current flows through the bridge wire which current quickly heats the bridge wire and the sensitive explosive which is in intimate contact with the bridge wire to a temperature at which the temperature sensitive explosive ignites. The pressure of the gases produced by the burning of the temperature sensitive material in the initiator chamber formed by the initiator recess and the printed circuit board causes the circular disc portion of the base between the initiator recess and the second circular recess to shear, or separate, from the base substantially at the perimeter of the disc. The disc is accelerated by the pressure of the gases in the initiator chamber to a sufficiently high velocity so that it has more than enough kinetic energy to initiate the stab sensitive explosive of the SSD which sets in motion forces which cause the bursting charge of the projectile to detonate when armed.

It is therefore an object of this invention to provide an improved electrically initiated detonator for a projectile.

It is yet another object of this invention to provide an improved electrically initiated detonator for a projectile at minimum cost.

It is still another object of this invention to provide an improved electrical initiator for a stab sensitive detonator.

It is another object of this invention to provide an improved electrically initiated detonator for a projectile the volume of which is minimized.

BRIEF DESCRIPTION OF THE DRAWINGS

Other objects, features, and advantages of the invention will be readily apparent from the following description of the preferred embodiment thereof, taken in conjunction with the accompanying drawings, although variations and modifications may be effected without departing from the spirit and scope of the novel concepts of the disclosure, and in which.

DESCRIPTION OF THE PREFERRED EMBODIMENT

Figure 1:
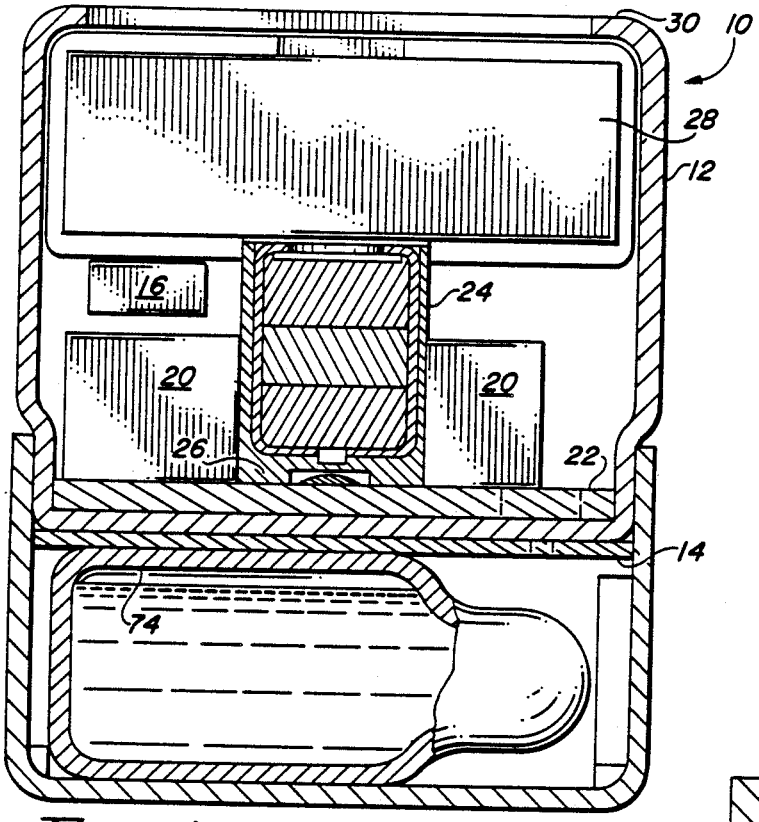
FIG. 1 is a cross section of an electronic fuze for a projectile in which the detonator of this invention is incorporated.

In FIG. 1, electronic fuze 10 includes a housing 12 within which is located reserve battery 14. Fuze 10 includes a sensor 16 for sensing when the projectile in which fuze 10 is mounted strikes a target, after the projectile is fired from a gun, for example. Fuze 10 also includes a digital clock circuit as well a circuit means for producing an arming signal after the projectile with fuze 10 in its base is fired and a predetermined delay period has elapsed and thereafter a fire signal is produced by fuze 10 when sensor 16 determines that the projectile in which fuze 10 is mounted has struck a target. Capacitor 20 is charged by battery 14 after the battery is energized which occurs at the time of firing caused by set back forces as is well known in the art. Fuze 10 includes a circuit board 22 on which conductor runs are formed to electrically interconnect the various components of fuze 10 and on which a conventional solid state digital clock circuit is mounted. Detonator 24 has its base 26 mounted on circuit board 22.

Safing and arming (S&A) device 28 is located in the upper portion of fuze housing 12 as is illustrated in FIG. 1 between detonator 24 and the high explosive bursting charge of a projectile which is not illustrated, but which is positioned in close proximity to the upper face 30 of fuze housing 12. For details of the structure and operation of S&A device 28, reference is made to the concurrently filed patent application entitled "Safing and Arming Mechanism" further identified in the section of this application entitled "Cross-Reference to Related Applications".

Figure 2:
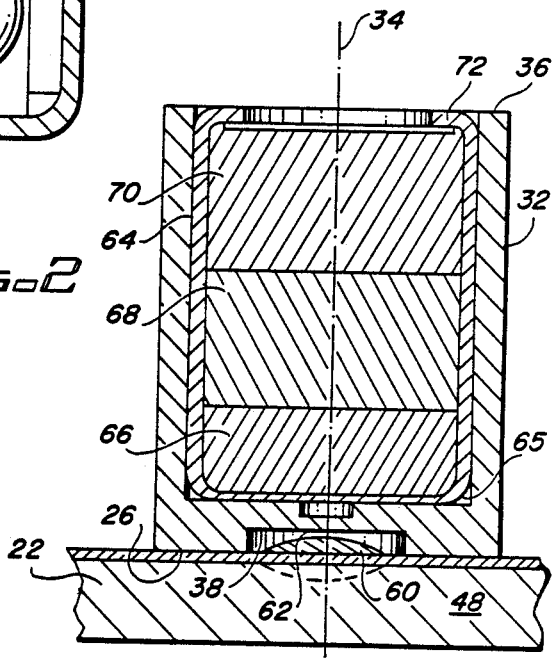
FIG. 2 is an enlarged cross section of the detonator.
Figure 3:
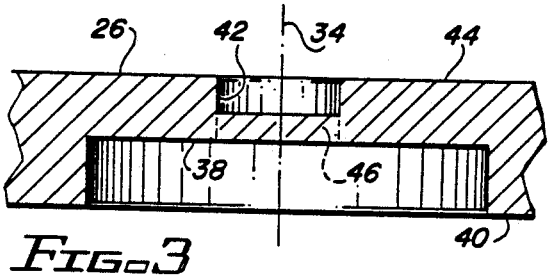
FIG. 3 is an enlarged fragmentary view of a portion of the base of the detonator.

Detonator 24, as is best seen in FIG. 2, has a housing 32 which is substantially cylindrical and symmetric with respect to its cylindrical axis, or axis of symmetry, 34. The wall forming base 26 is integral with side wall 36 of housing 32. A circular initiator recess 38 is formed in the outer surface 40 of base 26. A second circular recess 42, as is best seen in FIG. 3, is formed in the inner surface 44 of base 26. The centers of circular recesses 38, and 42 substantially lie on axis 34 of detonator 24. The circular disc, or plate 46 between recess 42 and recess 38 has a diameter substantially equal to that of recess 42 and is of substantially uniform thickness.

Figure 4:
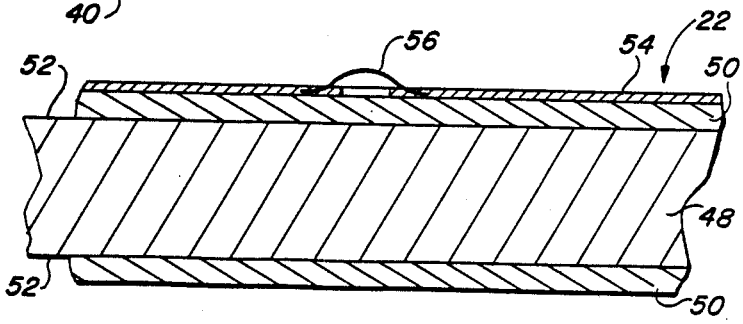
FIG. 4 is an enlarged section through a portion of the circuit board showing additional details of the bridge wire.

Referring to FIG. 4, circuit board 22 has a base 48 of a material that can withstand the set back forces to which the fuze 10 is subjected when a projectile containing fuze 10 is fired from a gun. In the preferred embodiment, base 48 is made of stainless steel. A suitable insulation layer 50, porcelain, in the preferred embodiment, is secured to surfaces 52 on both sides of base 48 and a conductive layer 54 of a suitable electrical conductor such as copper is formed on the top insulating layer 50. The bridge wire 56 is placed directly in the conductive layer 54 while conductive layer 54 is still in a paste form. Conductive layer 54 is then hardened by being fired. As a result, the bridge wire 56 is then electrically and mechanically connected to the copper layer 54.

Bridge wire 56 is coated with a temperature sensitive explosive 60, lead styphnate in the preferred embodiment. Detonator 24 is then secured to circuit board 22 with recess 38 and circuit board 22 forming an initiator chamber 62 in which bridge wire 56 and temperature sensitive explosive 60 are located. Conventional stab sensitive detonator 64 is positioned within detonator housing 32. Stab sensitive end 65 of SSD 64 is positioned in substantial contact with inner surface 44 of base 26. Stab sensitive explosive 66 is positioned in stab sensitive end 65 of SSD 64. An intermediate strength explosive mix 68 is located between stab sensitive mix 66 and high explosive material 70.

In the preferred embodiment, housing 12 is made of a suitable material, such as steel or aluminum, and housing 32 of detonator 24 is preferably made of aluminum. Stab sensitive mix 66 is NOL-130, intermediate mix 68 is lead azide, and high explosive 70 is RDX in the preferred embodiment. Housing 72 of stab detonator 64 is preferably made of aluminum.

When the projectile in the base of which fuze 10 is located is fired, the frangible electrolyte container 74 of reserve battery 14 is fractured by the set back forces to energize reserve battery 14. Capacitor 20 then is charged by battery 14. S&A device 28 remains in its safe state, or condition, blocking the firing train between detonator 24 and the bursting charge of the projectile. Fuzing system 10 will produce an arming signal a predetermined period of time after the projectile is fired, a time period which allows the projectile to proceed a safe distance from the gun firing it. Capacitor 20 will partially discharge through the bridge wire of the electrically initiated actuator of S&A device 28 to arm the projectile which will complete the firing train between detonator 24 and the bursting charge of the projectile as described in application entitled "Safing and Arming Mechanism" concurrently filed herewith. This partial discharge constitutes the arming signal produced by fuze 10.

At such time, after fuze 10 produces an arming signal, as sensor 16 detects that the projectile has struck, or intercepted a target, fuze 10 will produce a firing signal. The production of the arming signal is delayed for a predetermined short period of time in the preferred embodiment to permit the firing signal to be produced after the projectile has penetrated into the interior of the target, such as an aircraft. The firing signal is the discharge of capacitor 20 through bridge wire 56. The large current of the fixing signal flowing through bridge wire 56 provides more than enough energy to ignite temperature sensitive material 60, lead styphnate in the preferred embodiment. Material 60 which is applied as a slurry to bridge wire 56 and then dried tends to substantially surround, or encompass bridge wire 56. This results in most of the thermal energy produced by the firing current flowing through the bridge wire 56 being applied to material 60. Material 60 when heated to its ignition temperature burns rapidly to produce gases, the pressure of which within initiator chamber 62 can rapidly reach a magnitude at which the material of base 26 at the periphery of disc 46 fails in shear. Disc, or plate, 46 is accelerated by the high pressure of the gases produced by material 60 in initiator chamber 62 to a sufficiently high velocity to activate stab sensitive mixture 66. Stab sensitive mixture 66 has sufficient energy to detonate intermediate mix 68 which in turn initiates, or causes high explosive 70 to detonate. Detonation of high explosive material 70 of stab sensitive detonator 64, when S&A device 28 is in its armed condition will detonate the high explosive bursting charge of the projectile in which fuze 10 is located.

From the foregoing it is believed obvious that the improved detonator 24 of this invention provides a reliable way of electrically initiating a stab sensitive detonator to initiate a high explosive charge of a small caliber projectile using an electronic fuze. The structure and location of detonator 24 in fuze 10 reduces the overall size of fuze 10 while increasing its reliability and concurrently minimizing the cost of producing the device.

While the principles of the invention have now been made clear in the illustrated embodiment, there will b immediately obvious to those skilled in the art, many modifications of structure, arrangements, proportions, elements, materials, and components used in the practice of the invention, and otherwise, which are particularly adapted for specific environments and operation requirements, without departing from those principles. The appended claims are therefore intended to cover and embrace any such modifications within the limits only of the true spirit and scope of the invention.

What is claimed is:

1. An electrically initiated stab sensitive detonator (24) for a projectile comprising:

means forming a hollow substantially cylindrical detonator housing (32) having an axis of symmetry (34), said means forming housing (32) having a base (26), said base (26) closing one end of the means forming housing (32), said base (26) having an inner surface (44) and and outer surface (40);

a first cylindrical recess (38) formed in the outer surface (40) of the base (26);

a second cylindrical recess (42) formed in the inner surface (44) of the base (26), the portion of the means forming the base (26) between the two recesses (38), (42) defining a disc (46) of substantially uniform thickness;

a circuit board (22) including means for conducting an electrical current (54);

bridge wire means (56) mounted on circuit board (22) in electrical contact with the means for conducting an electrical current (54) for conducting an electrical current through said bridge wire means (56);

a temperature sensitive explosive (60) in contact with the bridge wire means (56); and a stab sensitive detonator (64) having a stab sensitive end (65) placed in the detonator housing with the stab sensitive end (65) in proximity to the inner surface (44) of the base (26), said detonator housing (32) being mounted on the circuit board (22) so that the first screen recess (38) overlies the bridge wire (56) and the temperature sensitive explosive (60), a firing signal electrical current flowing through bridge wire (56) igniting temperature sensitive explosive (60) to separate disc (46) from base (26) and to accelerate disc (46) to a velocity to activate stab sensitive detonator (64) as disc (46) impacts stab sensitive end (65) of detonator (64).

2. A detonator (24) as defined in claim 1 in which the first and second cylindrical recesses (38), (42) have axes which substantially coincide with the axis of symmetry (34) of housing (32).

3. A detonator (24) as defined in claim 2 in which the insulating layer (52), between base (48) and bridge wire (56) is absent.

4. A detonator (24) as defined in claim 3 in which the temperature sensitive explosive (60) substantially surrounds bridge wire (56).

5. A detonator (24) as defined in claim 4 in which base (48) of circuit board (22) is made of stainless steel.

6. A detonator (24) as defined in claim 5 in which insulating layer (54) is a ceramic.

7. An electrically initiated stab sensitive detonator (24) for a projectile comprising:

a hollow substantially cylindrical detonator housing (32) having and axis of symmetry (34);

means forming a base (26) of the housing (32), said means forming a base (26) closing one end of the cylindrical housing (32), said means forming a base having an inner surface (44) and an outer surface (40);

a cylindrical initiator recess (38) formed in said outer surface (40);

a cylindrical stress concentrating recess (42) formed in said inner surface (40), the means forming a base (26) between the two recesses (38), (42) defining a disc of substantially uniform thickness;

a circuit board having a metal base (22), a layer of insulating material (52) overlaying the base (48), and a conductive layer (54) overlaying the layer of insulation material (52);

a bridge wire (56) mounted on circuit board (22) in electrical contact with conductive layer (54) so that an electrical current can flow through bridge wire (56);

a temperature sensitive explosive (60) in contact with the bridge wire (56); and a stab sensitive detonator (64) having a stab sensitive end (65) placed in the detonator housing (32) with the stab sensitive end (65) of detonator (64) being in proximity to the inner surface (44) of the base (26), said detonator (32) being mounted on the circuit board (22) so that the initiator recess (38) overlays the bridge wire (56) and the temperature sensitive explosive (60), an electrical current firing signal flowing through bridge wire (56) igniting temperature sensitive explosive (60) to sever disc (46) from base (26) and to force disc (46) into the stab sensitive end of stab sensitive detonator (64) with sufficient kinetic energy to cause detonator (64) to detonate.

8. A detonator (24) as defined in claim 7 in which the layer of insulation between the bridge wire (56) and base (48) is removed and the temperature sensitive explosive (60) substantially surrounds bridge wire (56).

9. A detonator (24) as defined in claim 8 in which initiator recess (38) and circuit board (22) form an initiator chamber (62).

10. A detonator (24) as defined in claim 9 in which base (48) of circuit board (22) is made of stainless steel.

11. A detonator (24) as defined in claim 10 in which the layer of insulation (50) is a ceramic material.

12. A detonator (24) as defined in claim 11 in which the conductive layer (54) is copper.

13. The detonator (24) as defined in claim 11 in which the temperature sensitive explosive (60) is lead styphnate.

* * * * *